US006092585A

United States Patent [19]

Larsen et al.

[11] Patent Number: 6,092,585

[45] Date of Patent: Jul. 25, 2000

[54] METHOD AND ARRANGEMENT FOR CONVEYING MOULDS WITH CASTINGS THEREIN

[75] Inventors: Jens Peter Larsen, deceased, late of Glostrup, by Michael Peter Larson; Emil Jespersen, Glostrup, both of Denmark

[73] Assignee: Georg Fischer Disa A/S, Herlev, Denmark

[21] Appl. No.: 08/913,971

[22] PCT Filed: Mar. 28, 1996

[86] PCT No.: PCT/DK96/00128

§ 371 Date: Dec. 22, 1997

§ 102(e) Date: Dec. 22, 1997

[87] PCT Pub. No.: WO96/30140

PCT Pub. Date: Oct. 3, 1996

[30] Foreign Application Priority Data

Mar. 30, 1995 [DK] Denmark ..... 0345/95

[51] Int. Cl.[7] ..... B22C 11/10; B22D 29/00; B22D 33/04; B22D 47/02

[52] U.S. Cl. ..... 164/130; 164/131; 164/168; 164/344

[58] Field of Search ..... 164/18, 40, 76.1, 164/130, 131, 167, 168, 270.1, 322, 323, 344

[56] References Cited

U.S. PATENT DOCUMENTS

| | | | |
|---|---|---|---|
| 3,840,066 | 10/1974 | Taccone | 164/130 X |
| 3,967,667 | 7/1976 | Wallwork | 164/40 X |
| 4,112,999 | 9/1978 | Gasper | 164/168 X |
| 4,438,801 | 3/1984 | Buhler | 164/323 X |
| 4,846,251 | 7/1989 | Achinger . | |

FOREIGN PATENT DOCUMENTS

| | | | |
|---|---|---|---|
| 0013062 | 7/1980 | European Pat. Off. . | |
| 0385245 | 9/1990 | European Pat. Off. . | |
| 2404907 | 2/1976 | Germany . | |
| 4034405 | 5/1991 | Germany . | |
| 62-171816 | 7/1987 | Japan . | |
| 1-91959 | 4/1989 | Japan | 164/323 |
| 1212688 | 2/1986 | U.S.S.R. | 164/167 |

*Primary Examiner*—J. Reed Batten, Jr.
*Attorney, Agent, or Firm*—Larson & Taylor

[57] ABSTRACT

A method of advancing molds (5), after pouring to form castings (9) in the casting cavities (8), leaving a foundry plant comprising a mould-making station (A, 1–4) and a pouring station (B,7), the molds (5) leaving the plant in the form of closely juxtaposed mold parts (5) with the castings (9) in casting cavities (8) at the mainly vertical parting surfaces between successive molds (5), the latter constituting a mold string (F), in which each mold (5) occupies a given length (S) in the longitudinal direction of the mold string (F), the latter after having passed a precision conveyor (6, 16) being transferred to a second conveyor (10, 16, D). Each time the second conveyor (10) receives a mold (5) from the mold string (F), the second conveyor (10) is advanced in a controlled manner through a greater distance (S+s) than the length (S) of the individual mold (5) in the mold string (F), so as to produce an interspace (s) on the second conveyor (10) between consecutive molds (5) along the mainly vertical parting surfaces. The new method makes it possible to improve cooling, shorten the conveying distance, and reduce the production of dust.

18 Claims, 4 Drawing Sheets

METHOD AND ARRANGEMENT FOR CONVEYING MOULDS WITH CASTINGS THEREIN

TECHNICAL FIELD

The present invention relates to a method for conveying moulds with castings therein. In the method to which the invention relates, a mould string having castings in casting cavities formed between closely juxtaposed mould parts leaves a foundry plant which includes a mould-making station and a pouring station. The casting cavities are present at the mainly vertical parting surfaces between successive mould parts, and each mould occupies a given length in the longitudinal direction of the mould string. The mould string is moved on a precision conveyor and is thereafter transferred to a second conveyor. The second conveyor referred to is normally of a relatively light construction.

BACKGROUND ART

When making castings by pouring moulds with vertical parting surfaces, the moulds will normally be advanced along the pouring track on a precision conveyor, e.g. of the kind described in the DK patent publications Nos. 119,373 and 127,494; in this manner, the moulds or mould parts are placed in mutual abutment in a highly accurate manner, and this accuracy is maintained during the steps of pouring and solidification. After the pouring step, the moulds may be transferred to a conveyor of the kind described in DK-patent publication No. 138,840, making it possible to reduce the total frictional resistance against the movement of the moulds.

For the reasons referred to above, the moulds are frequently transferred at a relatively early stage in the process from the precision conveyor to a second conveyor producing less frictional resistance than the precision conveyor. This second conveyor may possibly be constituted by an endless belt. During the transfer to the second conveyor it must be ensured, either that the casting is sufficiently cooled to avoid the occurrence of cooling defects or deformations, or that the individual moulds are transferred in a manner preventing mutual displacements of the mould parts, possibly being the cause of deformations or cooling defects, respectively. Because of these relationships, the string of moulds will normally be transferred as a solid body through the second conveyor and advanced—still undivided—on the latter, until the castings have been cooled sufficiently, eventually to reach an extraction station.

An alternative to conveying the string of moulds as a continuous string to the extraction station is based on the use of devices to divide or break open the moulds in the mould string, e.g. of the kind shown in DK-B-129,397, in which such a device removes the central part of the moulds together with the castings. This alternative will, however, require the use of complicated equipment, the latter frequently having to be adapted to the particular castings being made and the particular moulds being used at any moment, especially when there is a change in the dimensions. Further, such an intermediate station will produce dust and fragments to be accounted for, as they can constitute a health risk and contribute to increased wear on moving parts.

Normally, however, the string of moulds will be advanced in the form of a continuous string on the second conveyor until the castings are cooled sufficiently for the extraction step. Further, if the second conveyor consists of flexible material incapable of withstanding high temperatures, such as e.g. is the case with endless belts of rubber or plastic material, it must be ensured, either that the castings do not come into contact with the conveyor belt during the extraction, or that the castings are cooled to a temperature not causing damage to the conveyor belt, the latter temperature frequently lying far below the temperature of solidification of the castings, thus requiring a disproportionately long cooling time on the conveyor belt.

A previously known automatic casting machine of the kind referred to above operates in the following manner. The moulds or mould parts are produced in a mould-making station, from which they are conveyed in the form of a closely packed string of moulds by a precision conveyor along a track to a pouring station, in which liquid casting material is poured into the casting cavities formed between the closely juxtaposed moulds or mould parts. After the pouring, the moulds or mould parts, now containing the casting material having been poured into them, are advanced, still in the form of a continuous string, along the casting track, during which the cooling is initiated in a cooling section. During this cooling it is important to prevent the moulds in the string of moulds from being displaced relative to each other, as this could otherwise result in deformations or cooling defects in the castings before the latter have been cooled to a shape-retaining temperature. For this reason, the length of the cooling section of the precision conveyor is often made sufficient to ensure that the castings are sufficiently cooled to be separated from the moulds in an extraction station. Especially when producing large castings, it becomes difficult to use long precision conveyors, because increased sand adhesion, produced by condensed moisture from the moulds, make the latter "stick" to the conveyor. In order to eliminate the effect of the sand adhesion, some plants are provided with a divided cooling section, in which the string of moulds is transferred to a driven conventional conveyor being synchronized with the precision conveying of the string of moulds, so that the latter is advanced without substantial displacement between the moulds occurring. When the cooling takes lace in a continuous string of moulds, the cooling section may, however, become very long, especially when producing large castings, because the moulds act as heat insulation. For this reason, the prior art has comprised attempts to shorten the cooling time by during the cooling step removing parts of the moulds or extracting the castings with a surrounding part of the moulds. This will, however, frequently require specially constructed apparatus adapted to the particular castings being made, and is also likely to produce large quantities of dust.

Thus, the purpose of the previously known second conveyor placed in extension of a precision conveyor has predominantly been to reduce the sand adhesion on the precision conveyor, and this has—to the extent that cooling is also provided during the movement on a conventional conveyor—resulted in relatively long conveying distances and cooling times possibly also a relatively large quantity of "burnt-out" binder in the mould material. Further, it has been necessary to use relatively complicated extraction stations, especially when it is necessary to prevent the castings from coming into contact with a flexible conveyor belt. These extraction stations normally produce a considerable amount of powder and dust from crushed mould parts, that should be avoided.

DISCLOSURE OF THE INVENTION

It is the object of the present invention to provide a method of the kind referred to initially, with which the disadvantages referred to above can be avoided or considerably reduced, and according to the invention, this object is achieved by each time said second conveyor receives a mould from the mould string, advancing the second conveyor in a controlled manner through a greater distance than the length of each mould received from the mould string, and stopping the second conveyor when it has advanced said greater distance so as to produce an interspace on the second conveyor between consecutive moulds. By proceeding in this manner, it is possible by using simple means to shorten the cooling time and/or extract the castings, while simultaneously avoiding the disadvantages referred to.

The present invention also relates to apparatus for carrying out the method of the invention. The apparatus includes means for advancing the second conveyor in such a manner that each time it receives a mould with a casting, the second conveyor is advanced in a controlled manner through a distance greater than the longitudinal space previously occupied by the mould relative to a succeeding mould part, and then stopped so that a relative displacement between the individual moulds in a direction away from each other takes place on the second conveyor, said displacement mainly being produced at said mainly vertical parting surfaces.

Thus, the present invention provides a number of advantages based upon the use of simple means. The cooling is intensified, and it may be controlled by increasing the surface of the individual moulds and allowing air to come into contact with the castings, made possible by the mutual separation of the moulds in the string of moulds. This also makes it possible to reduce the quantity of "burnt-out" sand in the mould, as the cooling of the moulds themselves is also intensified. Since it is only the distance, through which the second conveyor moves for each transfer step or cycle, that will possibly be altered when changing the size of the mould or casting, an adaptation to different castings will also be very simple. The invention is especially suitable for use when the temperature, to which the castings are to be cooled, depends on other parameters than the solidification temperature; this may be the case, when the castings at the solidification temperature still have a temperature capable of causing damage to other parts, such as a conveyor belt of a material not capable of with-standing high temperature, because the invention provides the possibility of opening the moulds and at the same time use them as heat insulation relative to the surrounding parts, such as the conveyor belt.

Further, the present invention provides the possibility of extracting the castings using simple means, since it is possible for a gripping device to engage the castings through the opening between the moulds without the necessity of breaking or destroying the latter. This makes it possible to simplify the construction of the extraction station and to reduce the production of dust. Alternatively, the invention makes it possible to use conveyors not specially constructed with a view to precision and temperature resistance, thus simplifying the construction.

In one embodiment, it is possible to achieve a controlled cooling in a number of steps.

In a further embodiment; the mould having been overturned will protect the conveyor belt against unintentional heating. This is especially of advantage during the casting extraction step.

The method of the invention may advantageously be carried out using one second conveyor.

The conveyor may advantageously be constituted by a conveyor belt.

When, further, this conveyor belt is provided with a sideboard or side rail, the quantity of mould parts and other impurities escaping from the conveyor belt will be reduced.

If, further, the belt is provided with spaced abutments, one of the effects achieved is that the conveyor belt itself can synchronize its movement to that of the string of moulds.

BRIEF DESCRIPTION OF THE DRAWINGS

In the following detailed portion of the present description, the invention will be explained in more detail with reference to the exemplary embodiments shown in the drawing, in which FIG. 1 diagrammatically and in perspective shows a part of a foundry plant embodying the invention.

DESCRIPTION OF THE PREFERRED EMBODIMENTS

Figure 1:
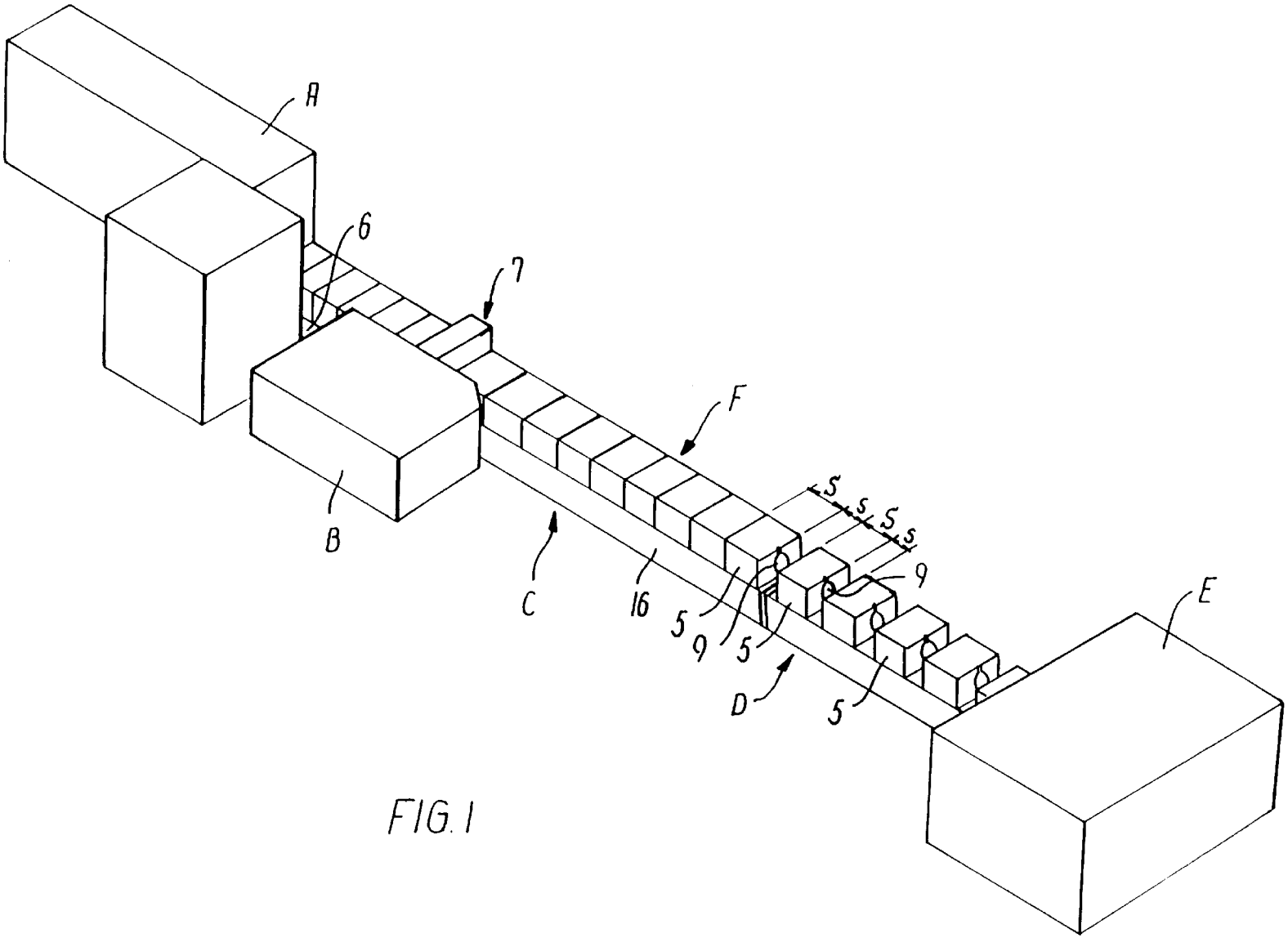

FIG. 1 shows an automatic foundry plant according to the present invention. Before being poured, the moulds are produced in a mould-making station A. The moulds 5 having been made are then transferred in the form of a closely packed string of moulds F on a precision conveyor 6 to the pouring station B,7, in which casting material is poured into the casting cavities formed between the closely packed moulds. After having been poured, the moulds with the castings are conveyed further on the precision conveyor 6, and during this part of the process, the cooling is initiated in a first cooling section C. During this cooling it is important that the moulds 5 in the string of moulds F are not moved relative to each other, as such movement may cause deformations or cooling defects in the castings 9 before the latter have been cooled to a temperature, at which they are stable with regard to shape. For this reason, the first cooling section C of the precision conveyor 6 is of a sufficient length to ensure that the castings 9 are sufficiently cooled to make them stable with regard to shape. Especially when producing large castings, the length of the conveyor can, however, reach such a magnitude that water evaporating in the moulds having been poured condenses near the surface of the mould and causes adhesion of sand, thus preventing precision conveying. To reduce the influence of the sand adhesion occurring as a result of the condensation of water, the plant may be provided with a divided cooling run, in which the string of moulds F passes onto a conveyor that is synchronized with the precision advancement of the string of moulds, so that the latter is moved forward without substantial relative movement between the moulds 5 occurring.

Figure 2A:
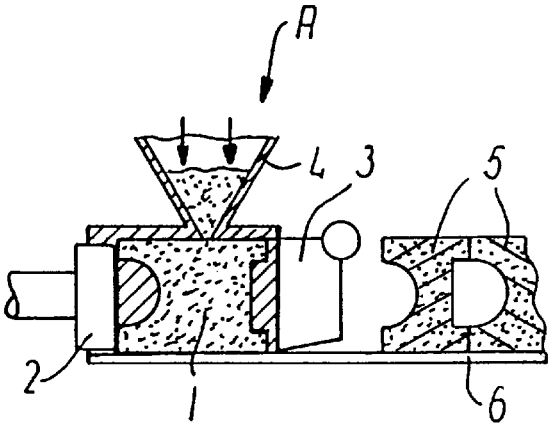
FIGS. 2*a*–2*c* show the operating principle for a previously known automatic mould-making machine.

This process will now be explained in more detail with reference to FIG. 2. Casting-mould parts in the form of moulds 5 consisting of mould sand or the like may be produced in a manner known per se by, as shown in FIG. 2*a*, introducing a suitable quantity of mould sand into the mould chamber 1 through a hopper 4, after which squeeze plates 2,3 are moved towards each other, causing the mould sand in the mould chamber 1 to be compacted so as to form the desired mould 5. The parts 1–4 are parts in the mould-making station A shown in FIG. 1.

Figure 2B:
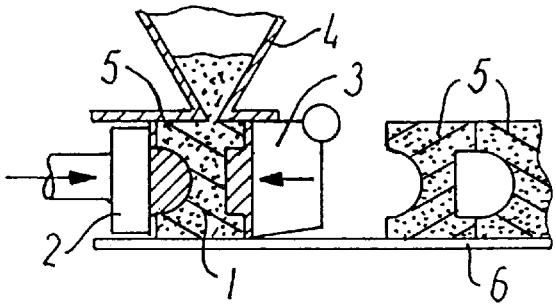
Figure 2C:
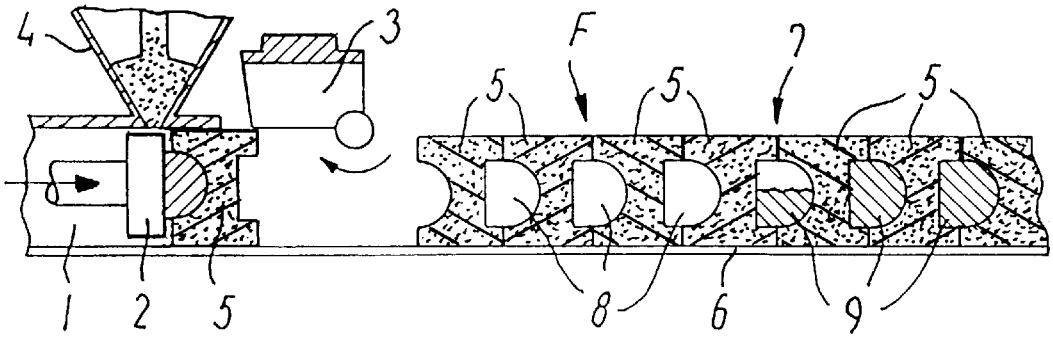
Figure 3A:
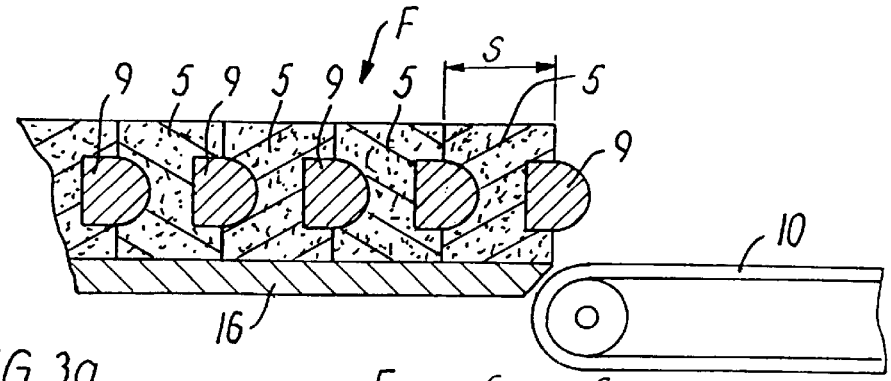
FIGS. 3*a*–3*d* show how the string of moulds is separated into individual moulds with interspaces as provided by the present invention.
Figure 3B:
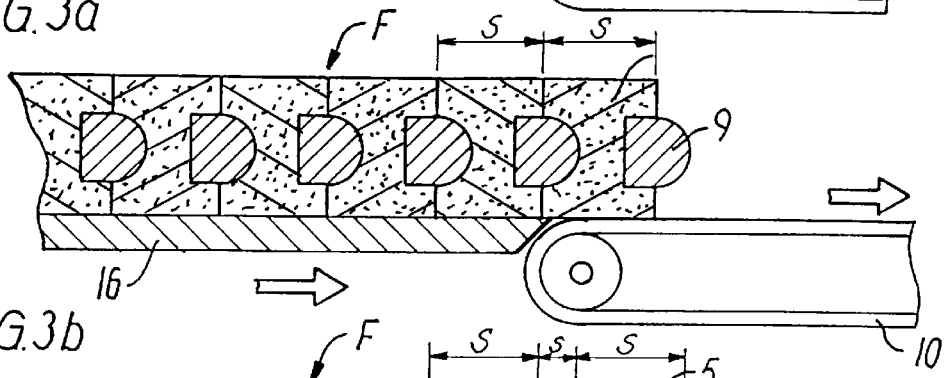
Figure 3C:
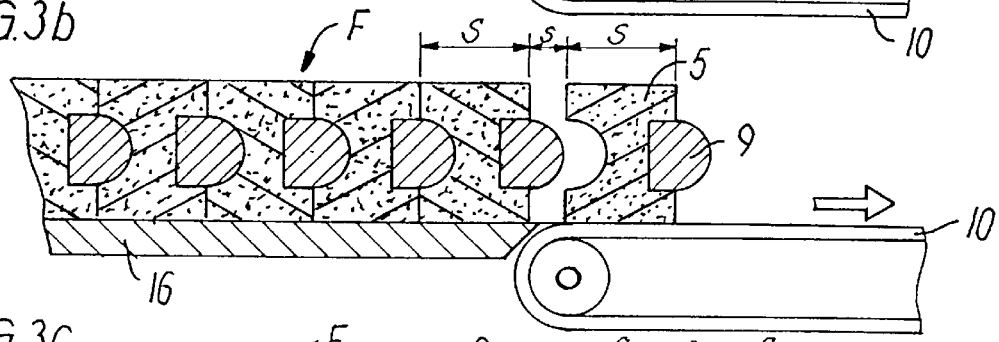
Figure 3D:
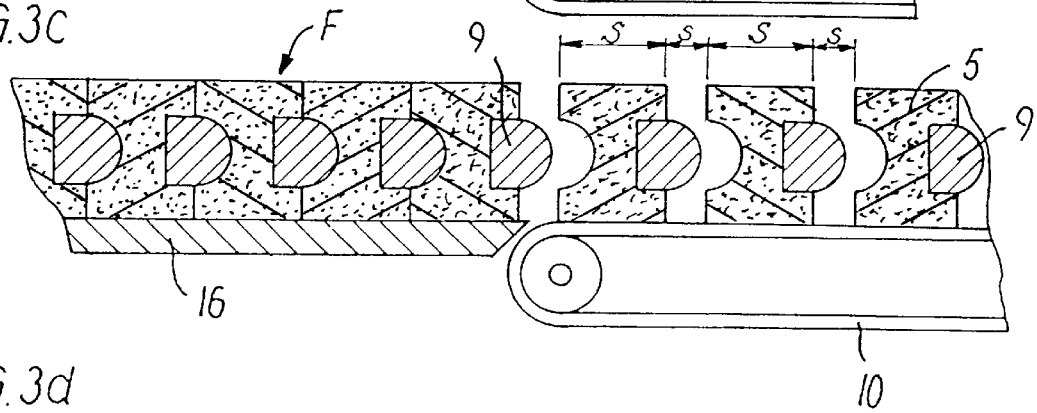

When, as shown in FIG. 2, the mould 5 has been formed, the squeeze plate 3 is pivoted away from the mould chamber 1 and the latter's bottom 6 as shown in FIG. 2*c*. After this, the squeeze plate 2 is advanced further with the mould 5 along the bottom 6, the latter continuing as the precision conveyor 6, so that the squeeze plate 2 moves the mould 5 forward into abutment with the previously formed mould 5 in the string of moulds 5 consisting of moulds 5 abutting against each other and now also comprising the most recently formed mould 5. After this, the squeeze plate 2 and the precision conveyor 6 move the string of moulds F one step further forward. Then, the squeeze plate 2 is withdrawn to its initial position, and the squeeze plate 3 is pivoted downwardly to its initial position, after which the process can be repeated.

Thus, the string of moulds F will be pushed forward step by step to the pouring region 7 (at the pouring station B in FIG. 1), in which casting material is poured into the casting cavities 8 formed between the moulds 5 so as to produce the desired castings 9. After the pouring, the precision conveyor 6 advances the moulds 5 with the castings 9 step by step in the form of an undivided string of moulds F, and during this movement, the cooling of the castings 9 is initiated in the first cooling section C shown in FIG. 1. Firstly, this cooling occurs by heat energy being transferred to the material in the moulds 5, after which the heat is conducted through this material and dissipated from its surfaces. During this conduction of heat after the immediate heating, the mould sand acts as heat insulation relative to the castings 9.

The string of moulds F continues on the precision conveyor 6 until it is transferred to the next conveying run. The succeeding conveying run may constitute an extension of the precision conveyor 6 and may be constructed and driven in such a manner that the moulds 5 will not be displaced relative to the string of moulds F, e.g. in the manner disclosed in DK-B-138,840, disclosing a conveyor belt being stabilized by rod-shaped means in engagement about the edges of the conveyor belt and accompanying the latter on a part of the conveying distance, thus preventing the moulds being opened by displacements relative to or in the belt.

After having passed along the precision conveyor 6,16 and its extension 16, if present, the unbroken string of moulds F will arrive at an end region of the precision conveyor 6,16 or the latter's extension 16 as shown in FIG. 3 constituting the terminal part of the first cooling section C as shown in FIG. 1.

According to the present invention, the moulds 5 with the castings 9 are transferred from the first cooling section C to the second cooling section D, the latter being a conveyor, shown in FIG. 3 in the form of a conveyor belt 10, that for each mould 5 being transferred is advanced through a greater distance S+s than the length S of the mould 5 previously having been transferred and entered into the string of moulds F, so that the latter is divided up with interspaces s between the moulds 5 along the latters' parting surfaces in the manner shown in FIGS. 1 and 3.

This means that the speed of the conveyor belt 10 as differentiated through a complete cycle of duration T is greater than the speed of the string of moulds F: $(S+s)/T>S/T$, because $s>O$.

The transfer as such may take place with uniform synchronized speed as between the string of moulds F and the conveyor belt 10, after which the string of moulds F stops while the conveyor belt 10 continues to advance e.g. 5–25 mm and then stops. With this cause of events, the continuous string of moulds F will be separated into individual moulds 5 with interspaces s adjusted to a desired magnitude, e.g. an interspace s of 5–25 mm.

This interspace s can contribute to augmenting the cooling effect by increasing the surface area of the moulds 5 and by creating direct access to the castings. The cooling effect may be adjusted by varying the size of the interspace s, and it may possibly be adjusted a number of times with transfer to a new conveyor, during which the distance s is further increased by an increment sx to a greater distance s+sx.

Figure 4:
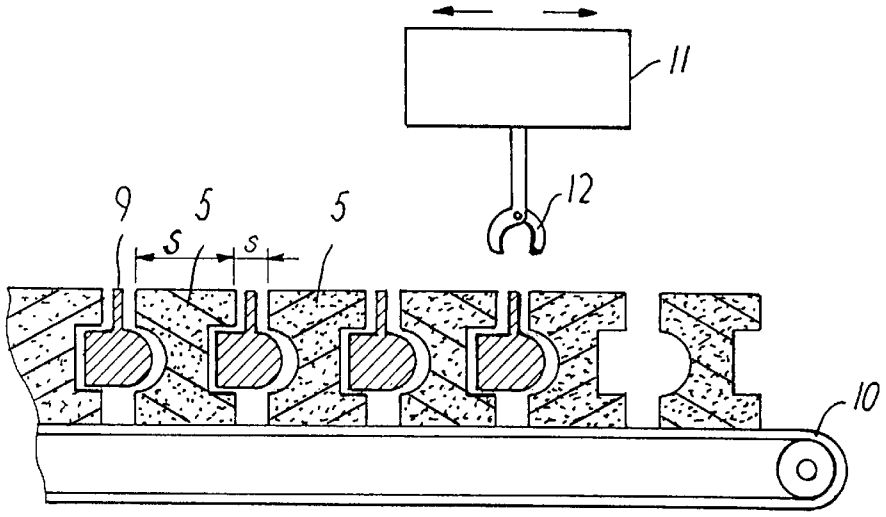
FIG. 4 shows castings being extracted from the moulds according to the invention.

Further, FIG. 4 shows the extraction of the castings 9, these being extracted mechanically at an extraction station 11 (in FIG. 1 being designated E), in which a gripping device engages the castings 9 through the interspaces s,sx between the moulds 5. This is a relatively simple operation, as it is not necessary for the gripping devices 12 to break open the moulds 5 in order to be able to engage the castings 9.

The extraction station 11 may comprise a machine or a robot situated in a suitable extraction location. The extraction station may comprise detectors for detecting the openings s,sx between the moulds 5 and/or the castings 9 by mechanical sensing, photocells, ultrasound, inductive sensors or the like. The extraction of the castings 9 from the moulds 5 may be carried out by the mould 5 embracing the casting 9 and being forwardmost in the direction of movement of the moulds being overturned in the forward direction by advancing the gripping device 12 in the extraction station 11 after having gripped the casting, after which the latter is moved away from the conveyor belt 10. It is also possible to carry out the extraction by lifting the castings 9 up through the moulds 5, thus breaking open the upper part of the moulds 5. What these methods of extraction have in common is that they are simple to carry out and produce a small quantity of dust, because the moulds 5 are not subjected to a crushing operation during the introduction of gripping devices in the mould itself, such as is otherwise normal in extraction stations.

An especially advantageous extraction is achieved by letting the gripping device 12 engage the castings 9 upstream of the end of the top run of the conveyor belt 10 and follow the latter's movement, the forwardmost mould 5 falling off the conveyor belt 10 at the end of the top run, after which the casting 9 is removed from the succeeding mould 5.

This type of extraction makes it possible to transfer the mould 5 being overturned from the conveyor belt directly to a collecting space without any previous crushing or breaking up taking place, thus avoiding the creation of dust.

Figure 5:
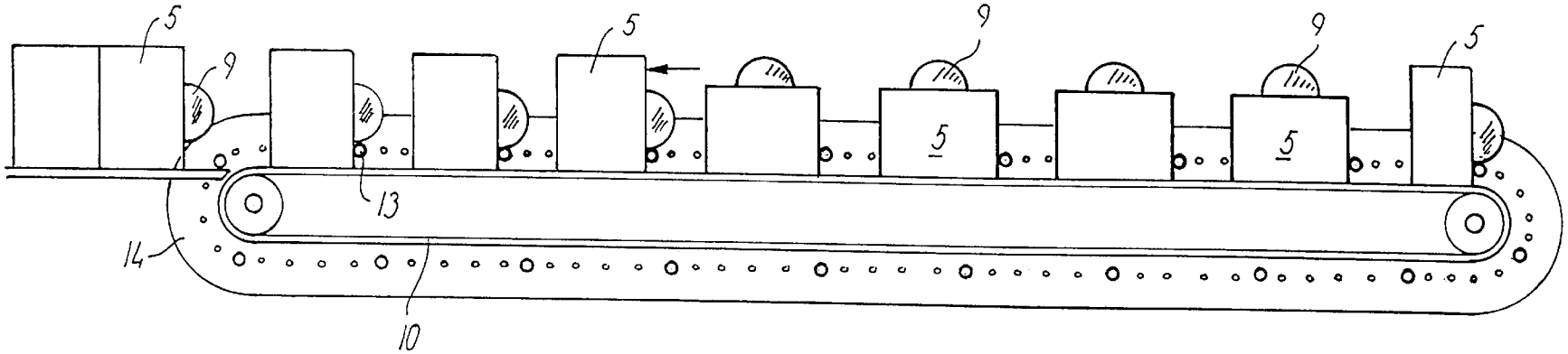
FIG. 5 shows how the moulds are separated from the string of moulds on a conveyor belt with spaced abutments and sideboards or side rails, during which step the moulds are overturned according to the present invention.

If the moulds 5 have such a shape that the castings 5 may be supported by one of them, the moulds can be moved with a relatively large mutual distance, thus improving the cooling and making it possible, if desired, to overturn the mould as shown in FIG. 5. When the mould 5 has been overturned, the conveyor belt 10 is protected against the influence of heat from the casting 9, because the mould 5 acts as heat insulation. Further, the mould 5 protects the conveyor belt 10 against hot falling parts from the castings 9 and hot particles coming loose in the region of the casting cavity in the mould 5, such as otherwise could especially constitute a problem during the extraction at the extraction station 11.

As shown and described, the conveyor 10 may be constituted by a conveyor belt, but it may also be constructed differently, e.g. in the form of a "travelling grate".

In the embodiment shown it is advantageous if the conveyor belt 10 is provided with sideboards or side rails, preferably having corrugations, causing mould parts or pieces from the moulds 5 to remain on the conveyor belt 10 to be collected at the downstream end.

The conveyor belt 10 may also be provided with spaced abutments 13 as indicated in FIG. 5, so that the string of moulds F will push the conveyor belt forward through a given distance when a mould 5 is being pushed onto the conveyor belt 10, as the forwardmost mould 5 in the string F will be advanced together with the latter until it engages an abutment 13, after which the conveyor belt 10 will be moved forward by the string F, and then, when the latter stops, the conveyor belt 10 continues to advance until a new abutment 13 is brought into position in front of the string of moulds F. E.g. in the beginning of the cycle time T, the speed of the string F may be greater than the speed of the conveyor belt 10, but differentiated over the complete cycle time T, the speed is greatest for the conveyor belt. These spaced abutments 13 may possibly be constructed and arranged in such a manner that their position may be altered according to the desired interspace between the moulds 5 and the size of the latter. The conveyor belt 10 itself may be arranged to be run freely or to be driven, the latter alternative comprising a partial drive for overcoming part of the frictional resistance, e.g. with a constantly acting advancing force corresponding to 90% of what is needed to advance the conveyor belt 10, thus relieving the string of moulds F, as during this part of the movement it is not subjected to the friction of the precision conveyor 6 and is only required to provide 10% of the requisite force for advancing the conveyor belt 10.

what is claimed is:

1. A method of advancing moulds, said moulds being in the form of closely juxtaposed moulds with castings in mould casting cavities at mainly vertical parting surfaces between successive moulds, said closely juxtaposed moulds constituting a mould string in which each mould occupies a given length in the longitudinal direction of the mould string, said method comprising the steps of:

moving the mould string on a precision conveyor; and thereafter transferring the moulds of said mould string to a second conveyor, wherein said transferring step comprises, each time said second conveyor receives a mould from the mould string, the steps of (a) advancing the second conveyor in a controlled manner through a greater distance than the length of each mould received from the mould string, and (b) stopping the second conveyor when it has advanced said greater distance so as to produce an interspace on the second conveyor between consecutive moulds:

wherein said precision conveyor is moved and said second conveyor is advanced synchronously during said transferring of said moulds; and wherein the advancing of said second conveyor is terminated later than the moving of said precision conveyor in order to create the interspace.

2. Method according to claim 1, further comprising transferring said moulds from said second conveyor to a further conveyor downstream of said second conveyor and, each time said further conveyor receives a mould from the second conveyor, advancing said further conveyor through a greater distance said distance advanced by said second conveyor, so that the interspace between successive moulds on said further conveyor is increased relative to the interspace between successive moulds on said second conveyor.

3. Method according to claim 1, further comprising overturning the moulds on said second conveyor after said interspace has been created between the moulds.

4. Method according to claim 1, wherein said second conveyor comprises a freely running conveyor, and wherein advancing said second conveyor is at least partially effected by movement of the mould string on said precision conveyor.

5. Method according to claim 1, wherein said second conveyor is driven by an applied force at least partially constituting the force required to advance said second conveyor.

6. Method according to claim 1, further comprising extracting said castings from said moulds on said second conveyor by gripping said castings at surfaces having been laid bare and not being embraced by the mould.

7. A method according to claim 1 further comprising stopping said precision conveyor at the time that said second conveyor has received a mould from said precision conveyor.

8. A method according to claim 1 further comprising transferring the mould string to an extension of the precision conveyor and thereafter transferring the moulds of said mould string to said second conveyor.

9. An apparatus for advancing moulds comprising:

a precision conveyor for conveying a string of moulds, the string comprising closely juxtaposed moulds in the form of moulds having castings in casting cavities at mainly vertical parting surfaces between successive moulds, a second conveyor for receiving moulds discharged from said precision conveyor, means for advancing the second conveyor in such a manner that each time it receives a mould with a casting, the second conveyor is advanced in a controlled manner through a distance greater than the longitudinal space previously occupied by the mould relative to a succeeding mould part, and then the second conveyor is stopped so that a relative displacement between the individual moulds in a direction away from each other takes place on the second conveyor, said displacement mainly being produced at said mainly vertical parting surfaces;

means for moving said precision conveyor and second conveyor synchronously during the receiving by said second conveyor of a mould being discharged from said precision conveyor; and wherein said advancing means stops the second conveyor later than the movement of the precision conveyor is stopped in order to create the interspace.

10. Apparatus according to claim 9 further comprising means for stopping said precision conveyor at the time that said second conveyor has received a mould from said precision conveyor.

11. Apparatus according to claim 9 wherein said precision conveyor includes a first conveyor and an extension.

12. Apparatus according to claim 9, further comprising a gripping device adapted to engage castings at surfaces of the castings having been laid bare by said relative displacement between individual moulds on said second conveyor.

13. Apparatus according to claim 9, wherein said second conveyor comprises a conveyor belt.

14. Apparatus according to claim 13 wherein said conveyor belt comprises an endless flexible conveyor belt.

15. Apparatus according to claim 13, wherein said second conveyor is provided with at least one sideboard or side rail.

16. Apparatus according to claim 15 wherein sideboard or said side rail is corrugated.

17. Apparatus according to claim 9, wherein said second conveyor is provided with spaced abutments.

18. Apparatus according to claim 17 wherein said spaced abutments are adjustable in position.

* * * * *